US008077902B2

(12) United States Patent
Weisman et al.

(10) Patent No.: US 8,077,902 B2
(45) Date of Patent: Dec. 13, 2011

(54) PLANAR FLEXIBLE VOICE COIL SUSPENSION

(75) Inventors: Richard L. Weisman, Pasadena, CA (US); Claude A. Vidal, Santa Barbara, CA (US); Russ J. Redmond, Goleta, CA (US); Michael Collinson, Goleta, CA (US); Paul Kaluzniak, Simi Valley, CA (US)

(73) Assignee: Advanced Bionics AG, Zug (CH)

( * ) Notice: Subject to any disclaimer, the term of this patent is extended or adjusted under 35 U.S.C. 154(b) by 974 days.

(21) Appl. No.: 11/990,465

(22) PCT Filed: Aug. 29, 2006

(86) PCT No.: PCT/US2006/033921
§ 371 (c)(1),
(2), (4) Date: Feb. 13, 2008

(87) PCT Pub. No.: WO2007/040875
PCT Pub. Date: Apr. 12, 2007

(65) Prior Publication Data
US 2010/0150391 A1 Jun. 17, 2010

(51) Int. Cl.
*H04R 1/00* (2006.01)

(52) U.S. Cl. ..... 381/404; 381/424

(58) Field of Classification Search ..... 381/396, 381/398, 400, 404, 423, 424
See application file for complete search history.

(56) References Cited

U.S. PATENT DOCUMENTS

| | | | | |
|---|---|---|---|---|
| 5,861,686 | A | 1/1999 | Lee | |
| 6,700,988 | B2 * | 3/2004 | Wu | 381/404 |
| 6,853,734 | B2 * | 2/2005 | Sahyoun | 381/404 |
| 7,426,283 | B2 * | 9/2008 | Kaiya et al. | 381/397 |
| 2002/0076079 | A1 * | 6/2002 | Tsuchikiri et al. | 381/407 |
| 2004/0218778 | A1 * | 11/2004 | Weisman | 381/396 |
| 2005/0111689 | A1 * | 5/2005 | True | 381/423 |
| 2005/0244031 | A1 * | 11/2005 | Nevill | 381/407 |

* cited by examiner

*Primary Examiner* — Savitr Mulpuri
(74) *Attorney, Agent, or Firm* — Arthur Freilich; Bryant R. Gold; Travis K. Laird

(57) ABSTRACT

A voice coil suspension system comprising a spider formed of flexible dielectric material defining a flexure portion configured to suspend a voice coil for axial displacement and an elongate connector portion for carrying flat electrical conductors for electrically connecting terminals of said voice coil to stationary electric contacts.

11 Claims, 4 Drawing Sheets

PLANAR FLEXIBLE VOICE COIL SUSPENSION

FIELD OF THE INVENTION

This invention relates generally to acoustic transducers which employ a moving voice coil. More particularly, the invention relates to a voice coil suspension system which affords high axial compliance and radial stiffness and provides an electrical connection between a moving voice coil and a stationary contact.

BACKGROUND OF THE INVENTION

Various electric to acoustic transducers (e.g., speakers) and acoustic to electric transducers (e.g., microphones) use a voice coil mounted for axial movement relative to a fixedly mounted magnet assembly. The voice coil is usually fastened to a diaphragm so that they move together enabling the diaphragm to produce or respond to acoustic energy. The voice coil is typically suspended by a resilient mechanism, often referred to as a "spider", which allows the voice coil to axially move from, and return to, a rest position. It is generally desirable that the spider provide high axial compliance and high radial stiffness.

Voice coil axial movement can be produced by driving an electric current through a voice coil winding. The current is typically sourced from a pair of stationary electric contacts and coupled to terminals on the voice coil by flexible wires. The voice coil movement flexes the wires and, in heavy duty applications, can cause wire fatigue and failure. This problem is of particular concern in the case of miniaturized transducers of the type useful in hearing aids where the winding may be formed of wire having a diameter as small as 0.001 inches.

SUMMARY OF THE INVENTION

The present invention is directed to a method and apparatus for suspending a voice coil to minimize space requirements while affording high axial compliance and high radial stiffness. Suspension systems in accordance with the invention are particularly suited for use in miniaturized acoustic transducers of a size which can be contained in cylindrical housings having a diameter on the order of 0.15 inches and an axial height on the order of 0.25 inches.

A voice coil suspension system in accordance with the invention includes a spider formed of flexible dielectric material, e.g., polyimide having a thickness on the order of 0.001 inches. The spider is structurally configured to define an outer ring having structural features within the outer ring arranged substantially symmetrically around a central axial opening. The spider structural configuration is designed to exhibit substantially uniform axial compliance and radial stiffness and avoid any tendency to rotate.

In accordance with a significant feature of the invention, the spider flexible material comprises a dielectric film, or substrate, which is used to carry at least one flat electrically conductive path for connecting a voice coil terminal to a stationary contact.

In a preferred embodiment, the spider substrate is cut from a thin flexible dielectric film to form a circular flexure portion and an integral elongate connector portion extending radially outward from the flexure portion. The electrically conductive path preferably comprises a thin planar trace (e.g., having a thickness on the order of (0.0007 inches) deposited on the substrate extending from an outer end of the connector portion (adapted for connection to a stationary contact) to a location on the circular flexure portion suitable for connection to a voice coil terminal.

In a preferred embodiment, the spider flexure portion is formed by cutting (e.g., laser cutting) arcuate openings through the spider substrate to define outer, inner, and intermediate concentric rings connected by radial links. More particularly, the outer ring is preferably connected to the intermediate ring by a first set of equally spaced radial links (e.g., three radial links positioned at 0°, 120°, 240°). The intermediate ring is preferably connected to the inner ring by a second set of equally spaced radial links (e.g., three radial links positioned at 60°, 180°, 300°). The inner ring surrounds a central axial opening and preferably includes radial tabs extending into the opening. The aforementioned elongate connector portion extends radially outward from the outer ring. At least one conductive path, e.g., copper having a width on the order of 0.004 inches and a thickness on the order of 0.0007 inches, is formed on the surface of the connector portion and extends along the rings to a tab for connection to a voice coil.

DETAILED DESCRIPTION

Figure 1:
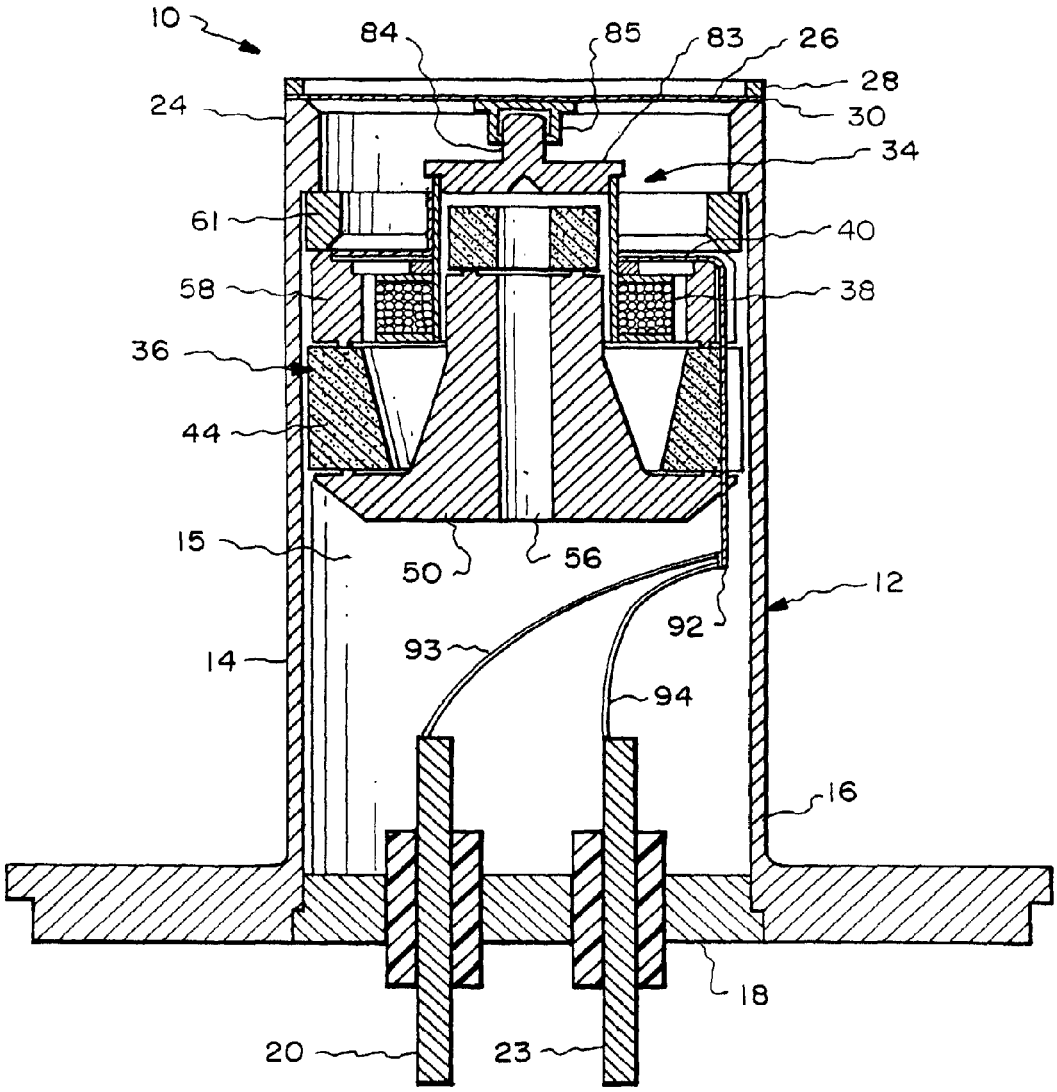
FIG. 1 is a vertical sectional view taken through the housing of an acoustic transducer in accordance with the present invention showing stationary electric contacts, a linear motor assembly, and a diaphragm.

Attention is now directed to FIG. 1 which illustrates an exemplary acoustic transducer 10 embodying the present invention. The transducer 10 is comprised of a housing 12 having a cylindrical tubular sidewall 14 enclosing an interior volume 15. The lower end 16 of the wall 14 is closed by a plate 18 carrying one or more stationary through contacts 20, 23 which provide for electric connectivity between the inside and outside of the housing 12. The upper end 24 of wall 14 is bridged by a flexible circular diaphragm 26 whose circumferential edge 30 is sealed to the upper edge of wall 14, e.g., by a clamp ring 28.

A linear motor 34 is mounted in the housing 12 for flexing the diaphragm 26 in accordance with a drive signal applied to the motor via the stationary contacts 20, 23. The linear motor 34 is shown in greater detail in FIG. 2 and is comprised primarily of a magnet assembly 36, a voice coil assembly 38, and a spider 40 for suspending the voice coil assembly 38 for axial movement relative to the magnet assembly 36.

The magnet assembly 36 is configured in substantially conventional fashion to produce magnetic flux lines extending radially across a toroidal air gap 42. More particularly, the magnet assembly 36 is depicted as including a cylindrical toroidal permanent magnet member 44 having an upper pole face 45 and a lower pole face 46. The lower pole face 46 is opposed by a horizontal flange portion 50 of a high permeability core member 52. The core member 52 includes a substantially vertical shaft portion 54 which defines a central axial opening 56. The upper pole face 45 is opposed by a high permeability toroidal member 58 which surrounds the air gap 42. The members 44, 52, and 58 cooperate to produce magnetic flux lines which traverse a closed path extending from upper pole face 45 through toroidal member 58, radially across air gap 42, downwardly through shaft portion 54, radially through flange portion 50 and then returning to magnet member 44 via lower pole face 46. A bucking magnet 60 is preferably mounted above shaft portion 54 to better concentrate the magnetic flux lines across gap 42.

The magnet assembly 36 is fixedly mounted in the housing 12 by a suitable means such as adhesive (not shown) applied between the permanent magnet member 44 and the inner surface of the sidewall 14. Additionally, the member 58 can be secured to mounting ring 61 which is fixed to the housing by a suitable adhesive (not shown).

Figure 3:
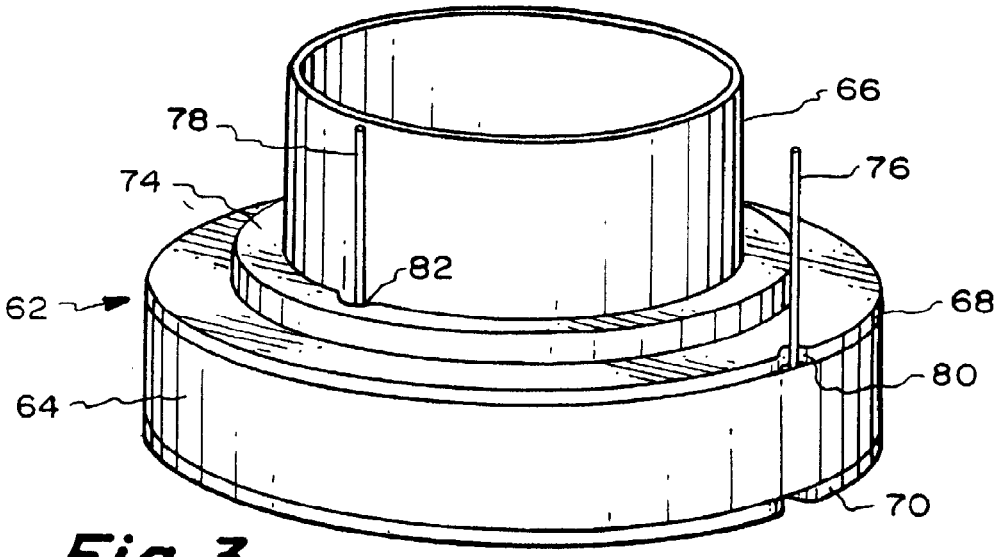
FIG. 3 is an enlarged perspective view of the voice coil subassembly of FIG. 2.

The voice coil assembly 38 is comprised of a bobbin case 62 (FIG. 3) which houses a multiturn winding 64 wound around a tubular bobbin 66. The winding 64 is housed between upper and lower flange members 68 and 70. A retention ring 74 is mounted around bobbin 66 and bears against upper flange 68. First and second terminals 76, 78 from winding 64 are brought out of the bobbin case 62, for example, through openings 80, 82 in flange 68 and ring 74.

A disk 83 is secured to the upper end of bobbin 66. The disk 83 carries a drive post 84 configured for retention in an inverted cup 85 secured to the undersurface of diaphragm 26. Consequently, axial movement of the voice coil assembly 38 correspondingly moves the center of diaphragm 26 (via drive post 84) to generate, or respond to, acoustic energy.

Figure 2:
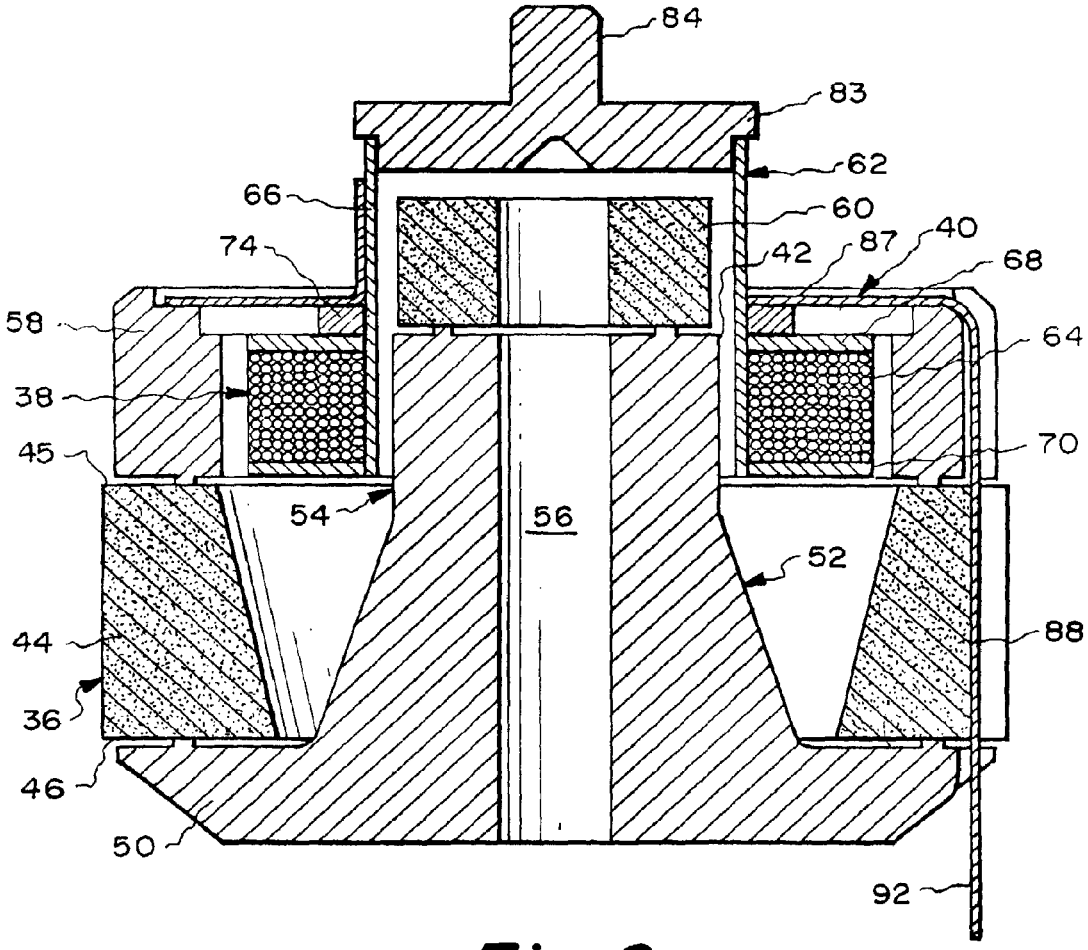
FIG. 2 is an enlarged sectional view depicting the linear motor assembly of FIG. 1 showing particularly the fixed magnet subassembly and the movable voice coil subassembly.
Figure 4:
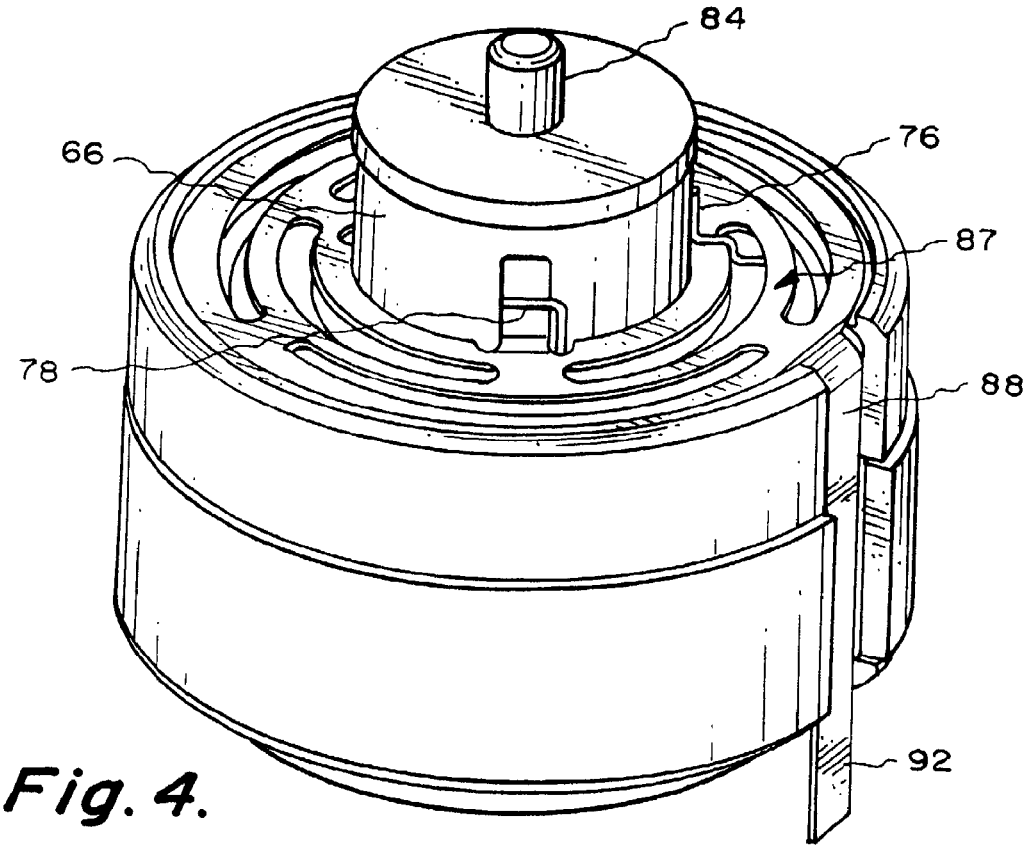
FIG. 4 is a perspective exterior view of the linear motor assembly of FIG. 2 showing particularly the suspension system in accordance with the invention comprising a planar flexible spider having a circular flexure portion and an integral elongate connector portion extending therefrom.

In accordance with the present invention, a planar spider 40 is provided for suspending the voice coil assembly 38 in the air gap 42. In the preferred embodiment, as shown in FIGS. 2 and 4, the planar spider 40 is mounted above and supported by the toroidal member 58. The spider 40 is preferably formed of a thin sheet 86 of dielectric material, e.g., polyimide film, having a thickness on the order of 0.001 inches. The spider sheet 86 is cut, as exemplified by FIG. 5, to form a circular flexure portion 87 and an elongate connector portion 88 extending radially outward therefrom. The central area of the flexure portion 87 is fastened to the voice coil assembly 38, e.g., by adhesion to the upper surface of retention ring 74, to suspend the voice coil assembly in the air gap 42 while the periphery of the flexure portion is fixed with respect to the magnet assembly 36. As will be explained further hereinafter, this configuration enables the voice coil to move axially relative to the magnet assembly 36.

The elongate connector portion 88 functions to carry flat electrically conductive paths, or traces 89, 90 (e.g., having a thickness on the order of 0.0007 inches) to locations on the flexure portion 87 for connection to the aforementioned voice coil terminals 76 and 78, as will be discussed hereinafter. The connector portion 88 is preferably secured adjacent to the outer periphery of magnet member 44 (FIGS. 2, 4) and extends to an outer end 92 which is connected by wires 93, 94 (FIG. 1) to the aforementioned stationary contacts 20 and 23.

Figure 5:
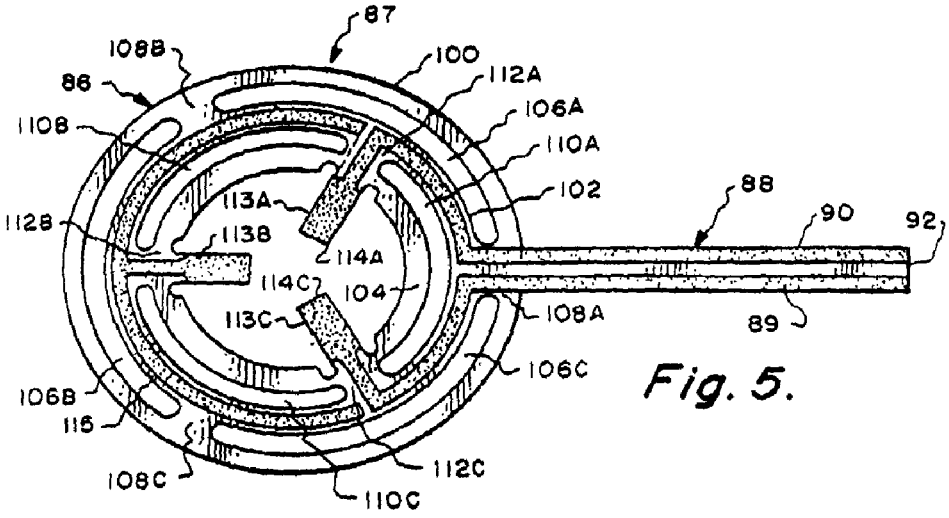
FIG. 5 is a planar representation of a dielectric substrate cut to form a preferred spider in accordance with the present invention and carrying electrically conductive traces.

With continuing reference to FIG. 5 note that the illustrated flexure portion 87 is comprised of concentric rings, e.g., an outer ring 100, an intermediate ring 102, and an inner ring 104. More particularly, the dielectric sheet 86 is preferably cut to remove arcuate portions 106A, 106B, and 106C to separate outer ring 100 from intermediate ring 102. Sheet material remaining at 108A, 108B, 108C forms a first set of N radial links between the outer and intermediate rings 100 and 102.

Similarly, arcuate areas of sheet material are removed at 110A, 110B, and 110C to separate intermediate ring 102 from inner ring 104. A second set of M radial links 112A, 112B, and 112C connect the intermediate and inner rings 102 and 104. The links 112A, 112B and 112C preferably extend radially inwardly beyond the inner ring to tabs 113. These tabs 113A, 113B, 113C are bent axially during assembly to bear against the outer surface of bobbin 66 as shown in FIG. 4.

It should be noted that the outer set of radial links 108A, 108B, and 108C are preferably displaced by 120° around the center of circular portion 86. That is, link 108A can be considered as positioned as 0°, 108B at 120° and 108C at 240°. The second set of links 112A, 112B, and 112C are preferably positioned intermediate the links of the first set. That is, links 112A, 112B, 112C are preferably positioned at 60°, 180°, 300°. Thus, the respective links are essentially symmetric with respect to the center of flexure portion 87.

The configuration of the flexure portion 87 shown in FIGS. 4 and 5 enables it to act as a flat coil spring. That is, an axial force applied to the inner ring 104 deflects it axially relative to the outer ring 100. When the force terminates, the inherent resiliency in the flexure portion 87 returns the rings to a coplanar relationship. Although, a particular preferred configuration is shown in FIG. 5, it is recognized that alternative geometries (e.g., FIGS. 6, 7) can be employed which similarly allow the central area of the flexure portion 87 to deflect axially relative to its periphery and then resiliently return to a coplanar rest position.

In accordance with the preferred spider embodiment shown in FIG. 5, the first flat electrical conductor 89 formed on the connector portion 88 extends from the outer end 92 to intermediate ring 102 and then along link 112A to a conductive pad 114A on tab 113A. The second flat electrical conductor 90 similarly extends from the outer end 92 of connector portion 88 to the intermediate ring 102 and along link 112C to a conductive pad 114C on tab 113C. In final assembly, the voice coil terminals 76 and 78 are respectively connected to the pads 114A and 114C, as by soldering.

The spider 40 in accordance with the invention can be fabricated using well known manufacturing techniques. For example, a sheet of polyimide bearing a layer of copper material can be laser cut to form the physical configuration shown in FIG. 5 and the copper layer can be photoetched to leave copper only in the stippled areas shown in FIG. 5. These areas of course include the aforementioned conductors 89, 90 which extend from the outer end 92 to the conductive pads 114A, 114C. Additionally, it is also preferable to retain copper on tab 113B and on portions 115 of intermediate ring 102 for the sake of physical axial symmetry to restrict voice coil motion to solely axial.

Figure 6:
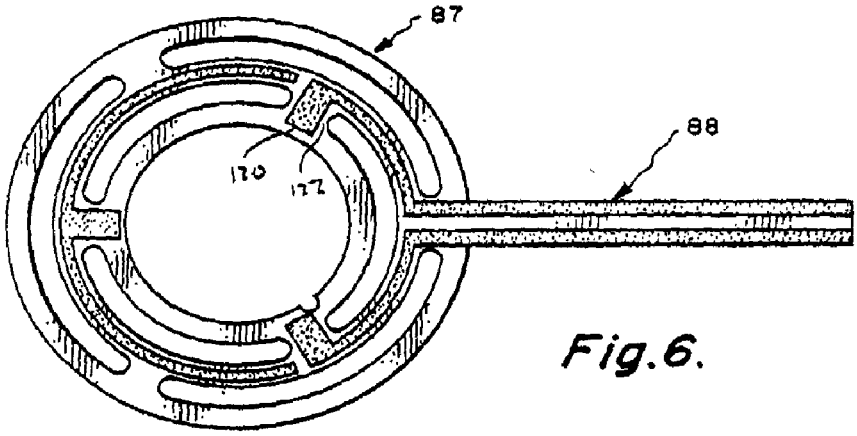
FIG. 6 is a planar representation of an alternative spider configuration in accordance with the present invention.

FIG. 6 illustrates one alternative spider configuration which is similar to FIG. 5 except that the inwardly projecting tabs 113 are eliminated. Instead, it is contemplated that the voice coil terminals are bent and directly soldered to the conductive traces 120 extending onto the radial links 122 between the intermediate and inner rings.

Figure 7:
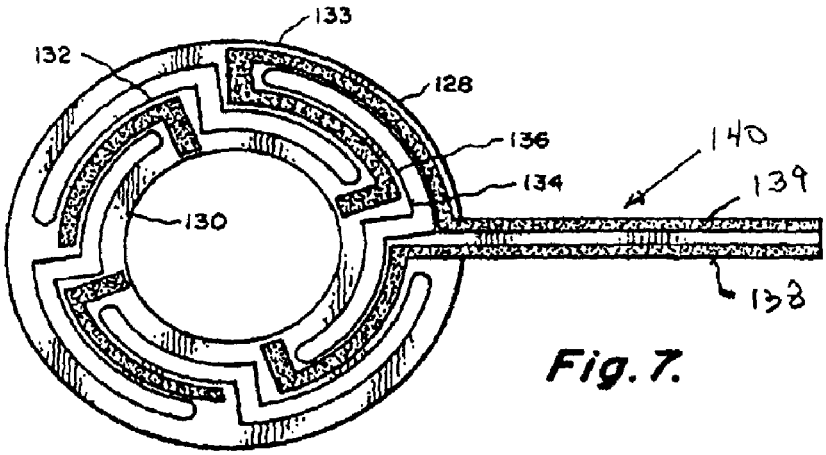
FIG. 7 is a planar representation of a further alternative spider configured in accordance with the present invention.

FIG. 7 illustrates a further alternative spider geometry in which an outer ring 128 is connected to an inner ring 130 via links 132. Each link 132 includes radial portions 133, 134 and an arcuate portion 136 extending between the radial portions and positioned between the inner and outer rings. Flat electrically conductive paths 138,139 are carried by an elongate connector portion 140 and extend to the inner ring 130.

From the foregoing, it should now be appreciated that a voice coil suspension has been described comprising a spider formed of flexible dielectric material defining a flexure portion for physically suspending a voice coil and an elongate connector portion for supporting a flat electrical conductor for electrically connecting a voice coil terminal to a stationary contact. The spider flexure portion is configured to readily permit voice coil axial movement and restrict radial and/or rotational movement. Although, only a limited number of spider geometries have been specifically described, it is recognized that modified and/or alternative geometries can be employed consistent with the spirit of the invention and within the intended scope of the appended claims.

The invention claimed is:

1. An acoustic transducer comprising:

a housing defining at least one stationary electrical contact;

a magnet assembly fixedly mounted in said housing and defining an air gap extending around a central axis;

a voice coil having at least one electric terminal;

spider means for suspending said voice coil for axial movement in said air gap, said spider means comprising:

a sheet of flexible dielectric material formed to define a circular flexure portion and having an elongate connector portion extending therefrom to an outer end; and at least one flat electrically conductive path formed on said dielectric sheet extending from said outer end adapted for connection to said stationary contact to a connection location on said flexure portion adapted for connecting to said electric terminal;

wherein said flexure portion comprises a concentric outer ring a concentric inner ring; and wherein said sheet of dielectric material defines a set of links connecting said outer ring to said inner ring and wherein said flexure portion further comprises a concentric intermediate ring disposed in between said concentric outer and inner rings; and wherein said set of links connecting said outer ring to said inner ring comprises a first set of radial links connecting said outer ring to said intermediate ring and a second set of radial links connecting said intermediate ring to said inner ring.

2. The transducer of claim 1 wherein said flexure portion is configured to exhibit high axial compliance and high radial stiffness.

3. The transducer of claim 1 wherein said first set of radial links is comprised of N links substantially uniformly distributed around said central axis and wherein said second set of radial links is comprised of M links substantially uniformly distributed around said central axis.

4. The transducer of claim 1 wherein said connection location comprises a tab extending inwardly from said inner ring.

5. The transducer of claim 1, further comprising:

a flexible diaphragm having a central area and a circumferential edge;

means for orienting said diaphragm perpendicular to said central axis for retention around said circumferential edge; and means for coupling said voice coil to said diaphragm central area for flexing said diaphragm.

6. The transducer of claim 1 wherein said sheet of dielectric material has a thickness on the order of 0.001 inches.

7. The transducer of claim 1 wherein said flat conductive path has a thickness on the order of 0.0007 inches.

8. A spider for supporting a voice coil for linear axial motion comprising:

a sheet of flexible dielectric material shaped to form a circular flexure portion and an elongate connector portion extending radially from said flexure portion to an outer end; and a flat electrically conductive path formed on said dielectric sheet extending from said outer end to a connection location on said flexure portion and wherein said outer end is adapted for connection to a stationary electric contact and said connection location is adapted for connection to a movable electric terminal;

wherein said flexure portion comprises a concentric outer ring, a concentric inner ring, and a concentric intermediate ring; and wherein said sheet of dielectric material defines a first set of radial links connecting said outer ring to said intermediate ring and a second set of radial links connecting said intermediate ring to said inner ring.

9. The transducer of claim 8, wherein said connection location comprises a tab extending inwardly from said inner ring.

10. The transducer of claim 8 wherein said sheet of dielectric material has a thickness on the order of 0.001 inches.

11. The transducer of claim 8 wherein said flat conductive path has a thickness on the order of 0.0007 inches.

* * * * *